United States Patent [19]

Lewins

[11] Patent Number: 4,529,105

[45] Date of Patent: Jul. 16, 1985

[54] VALVE UNIT FOR LIQUID CONTAINER

[75] Inventor: John D. Lewins, S. Wirral, England

[73] Assignee: Koninklijke Emballage Industrie Van Leer B.V., Amstelveen, Netherlands

[21] Appl. No.: 477,133

[22] Filed: Mar. 21, 1983

[30] Foreign Application Priority Data

Mar. 22, 1982 [GB] United Kingdom ..... 8208320

[51] Int. Cl.[3] ..... B67D 1/04

[52] U.S. Cl. ..... 222/153; 222/400.7; 137/212; 137/322

[58] Field of Search ..... 222/153, 400.7, 501, 222/488, 518, 464, 559; 137/322, 212; 251/149.6

[56] References Cited

U.S. PATENT DOCUMENTS

| | | | |
|---|---|---|---|
| 3,348,565 | 10/1967 | Turner | 137/212 |
| 3,454,199 | 7/1969 | Malick | 222/400.7 |
| 3,473,556 | 10/1969 | Johnson et al. | 137/322 |
| 3,591,057 | 7/1971 | Johnston | 222/400.7 |
| 3,937,246 | 2/1976 | Schots | 137/322 |

FOREIGN PATENT DOCUMENTS

| | | | |
|---|---|---|---|
| 2123347 | 12/1971 | Fed. Rep. of Germany | 137/212 |
| 1287170 | 8/1972 | United Kingdom . | |
| 2075476 | 11/1981 | United Kingdom . | |

*Primary Examiner*—Charles A. Marmor
*Attorney, Agent, or Firm*—Brumbaugh, Graves, Donohue & Raymond

[57] ABSTRACT

A valve unit fitted in the neck (26) of a liquid container (25) has a hollow plastics core element (1) supported within a metal housing which is assembled from two cup-shaped parts (12,13) provided with flanges (14,15) at their open ends which are welded together. The lower part (12) includes flow openings (19) and is adapted to support a flange (2) of the core element (1) while the upper part has a flange (20) which cooperates with valve member (11) and is surrounded by a sleeve (23) which secures the unit in the neck (26) of the container.

3 Claims, 6 Drawing Figures

VALVE UNIT FOR LIQUID CONTAINER

The invention relates to a valve unit for a liquid container, said unit comprising a tubular core element from thermoplastic material, said core element having an end closure wall with a slightly protruding flange and a row of radial openings below said end wall and flange, said tubular core element being surrounded by a helical spring, one end of which being supported by a radial extension of the core element, and the other end being in engagement with a ring valve the inner edge of which cooperates with the said end wall flange and the outer edge of which cooperates with the inner edge of an inwardly directed flange of a housing secured to the said radial extension, said core element being connected to a tube. A valve unit of this type is known from U.K. patent specification No. 1,287,170.

In said known valve unit, the radial extension supporting the helical spring and forming the connection with the housing is formed by a plurality of radially extending arms which are in engagement with downwardly extending legs of the housing according to a bayonet type interconnection. Above said downwardly extending legs the housing has been provided with outer screw threads and an outwardly extending flange with a few straight side edges such that the entire valve unit can be rotated by means of a tool. Said flange with side edges also has a function in the connection of the container and valve unit with a liquid draw-off pipe line system or dispensing system which when mounted pushes the ring valve away from its seat to open it and is held upon the said flange in the manner of a bayonet catch.

This known unit is relatively complicated in manufacturing.

Moreover in case of defects of the housing provided with outer screw threads at least a large part of the valve unit has to be replaced. If removal of the dispenser is done by an unskilled person who does not succeed in unlocking the bayonet catch, the valve unit might be screwed out because one has no choice as soon as the valve unit starts to unscrew.

If the container is still under pressure serious injuries are possible. Furthermore this unit can only be used in case the container has a neck portion with matching internal screw threads and cannot easily be adapted to different screw thread configurations.

Finally this valve unit cannot be made tamperproof.

The purpose of the invention is to obtain a closure unit which does not have the above-mentioned disadvantages, is very strong and extremely cheap to manufacture, easy to repair, suitable for different types of connections to the container, and which is safe.

According to the invention this purpose is achieved in that the housing is formed by two cylindrical cup-shaped metal parts, each having at their open end an outwardly extending radial flange, which flanges are welded upon each other. The lower one of said cup-shaped parts has openings in its wall, an inwardly curved bottom fitting over the flange-shaped radial extension of the core element, and a central opening to allow the passage of a draw-off tube. The upper cup-shaped part has a central opening, the diameter of which is smaller than the outer diameter of the ring valve and the support ring, and is surrounded by a bushing having a slide fit upon the cylindrical outer surface of said upper cup-shaped part.

The twp cup-shaped parts are easy to manufacture and the assembly is a simple operation because after mounting the spring and ring valve and the lower cup-shaped part in engagement with the radial flange of the core element, the upper-shaped part is pressed downwardly until its flange engages the flange of the other cup-shaped part after which the two parts are welded together. For mounting this unit a replaceable plastic ring having e.g. outer screw threads is shifted over the upper cup-shaped part until its lower edge engages the flanges interconnected by welding. The container has a screw threaded neck and an inner flange so that the interconnected flanges of the cup-shaped parts can be held in place by screwing down the outer ring.

Instead of screw threads different ways of connecting the valve unit to the container are possible, e.g. by means of a ring shifted over the cylindrical surface of the upper cup-shaped part and locking in place by clamping means or inwardly folded parts of the neck portion. The ring itself can be easily replaced in case of damage. Even under extreme pressure conditions the ring valve, the support ring and the spring cannot be ejected through the opening in the upper cup-shaped part.

Moreover, due to the invention, a valve unit comprising the core element, spring, valve and the two cup-shaped parts, held in place, e.g. by a screw threaded ring, can be used as well with a ring locked in place in a different way.

The tube can be connected to the core element, for example by adhering or bonding the elements together. According to the invention, a more advantageous construction is obtained if the tube has been connected to the core element by a slide fit of the tube end within the central bore of the core element, said tube having an outwardly directed circumferential ridge or bulge below the core element and supported by an inwardly bent inner edge portion of the bottom of the lower cup-shaped part. Bonded connections sometimes break. The preferred connection does not have this problem and in case necessary allows exchange of the tube.

As mentioned before the known valve unit has an upper flange edge configuration allowing the connection with a dispersing system. To achieve this the known valve unit has a flange with three straight edges allowing the engagement of a tool for screwing in and screwing out and allowing the connection with the dispensing system by means of a bayonet-type catch. This valve unit cannot be made tamper proof. A cap gripping around the flange and the neck portion of the container has to be removed before the bayonet catch can be applied and accordingly is not fully tamperproof.

According to the invention, the bushing has a flange of a shape allowing the cooperation with an in-screwing or out-screwing tool, said flange being covered by a plate having a radial flange with the edge configuration for the connection with the dispensing system and having a downwardly extending skirt folded inwardly around a shoulder of the neck portion. This means that the edge of the flange shaped for the engagement of a tool is covered after mounting the valve by a plate which makes the valve tamperproof and which may not be removed for the connection with the bayonet catch of the dispensing system. Removal shows that someone tried to obtain access to the contents of the container, whereas normal discharge through the dispensing system has become impossible.

The invention now will be further described with reference to the drawing showing the closure unit according to the invention in cross section.

Figure 1:
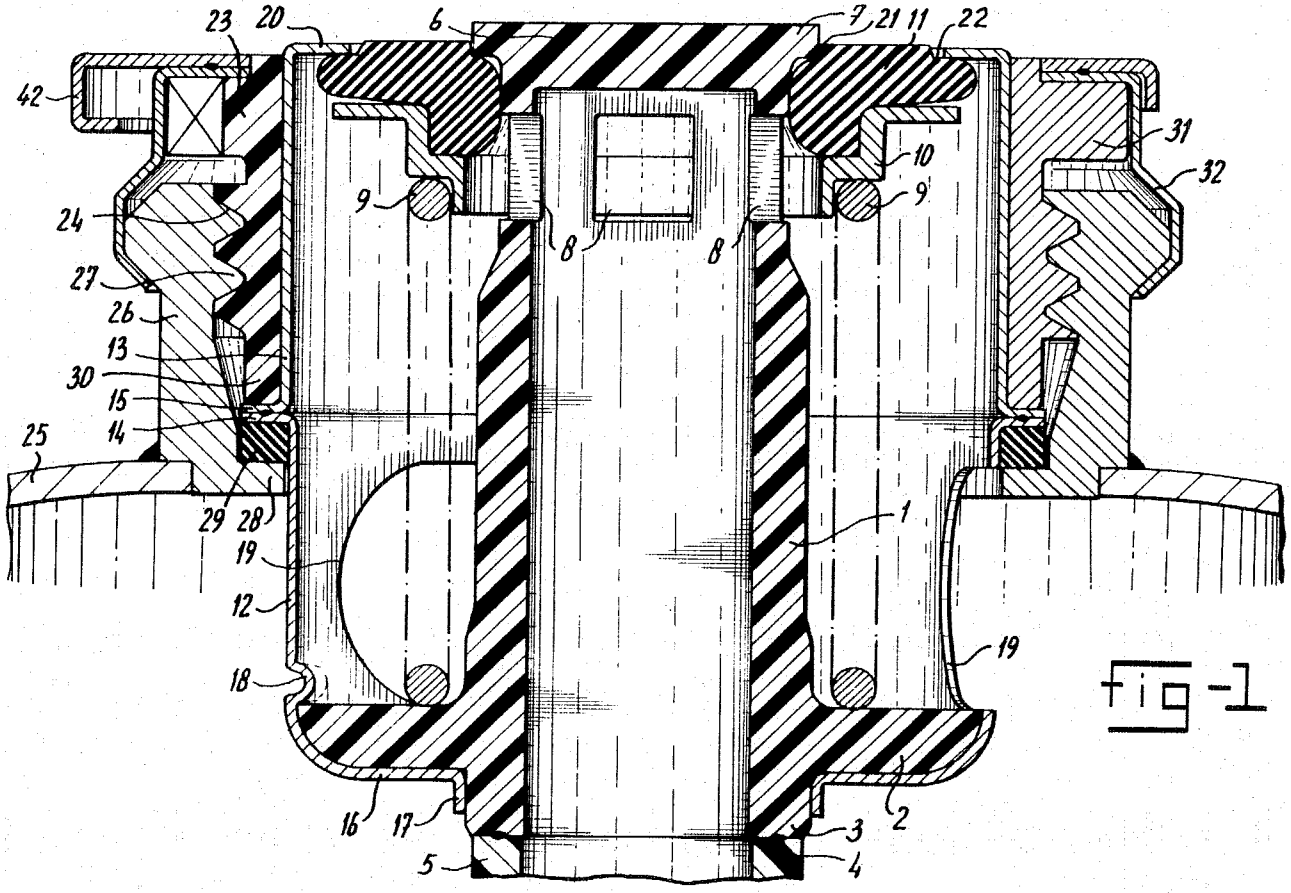
FIGS. 1 and 2 are cross sectional views of a first embodiment of the valve unit of the invention, shown in the closed and open positions, respectively
Figure 2:
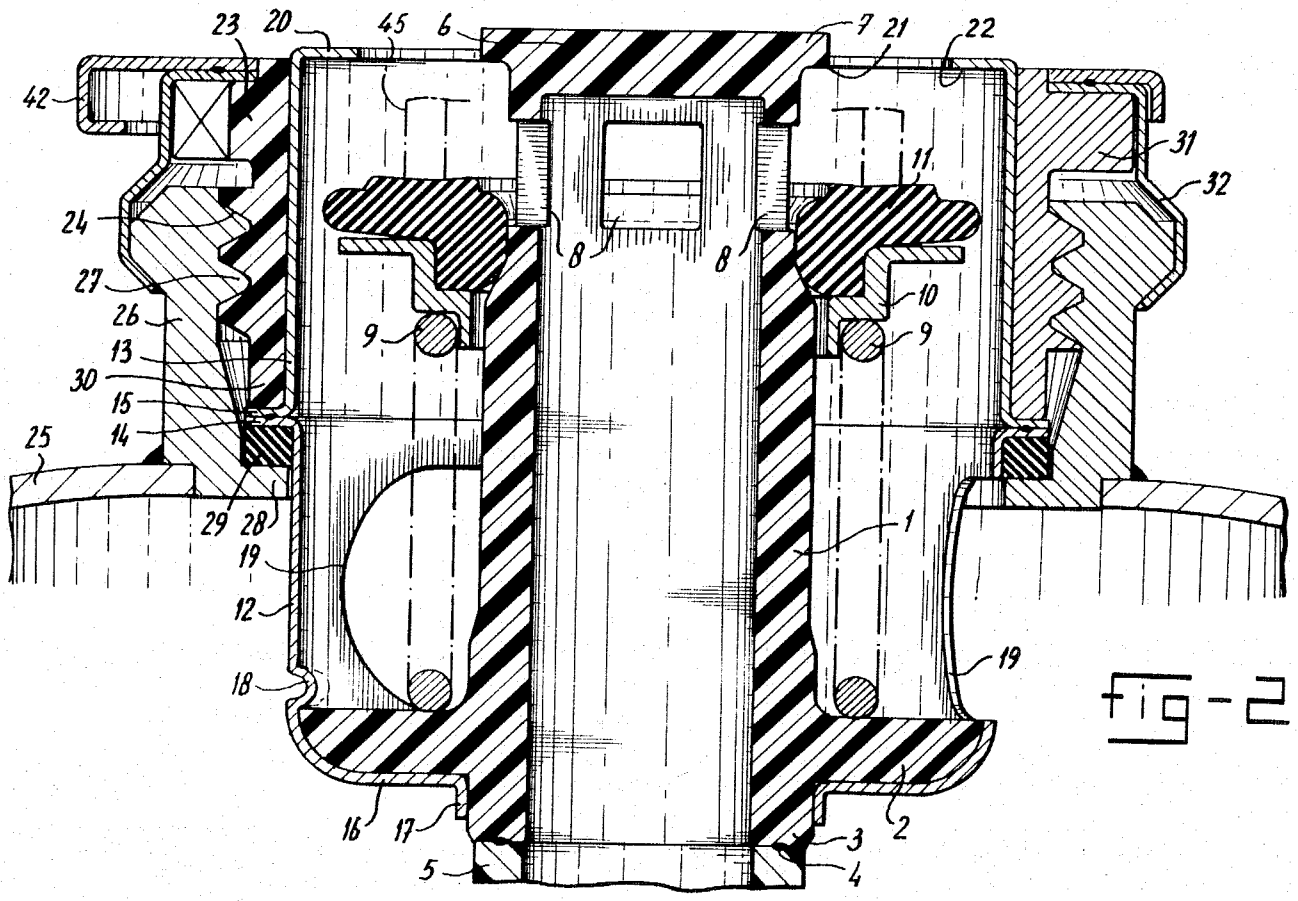

FIGS. 1 and 2 show a core element 1 having at its lower end a radial flange 2. A portion 3 of said tubular core element extends below the flange 2 and has been bonded at 4 to a tube 5. Both parts are made from a thermoplastic synthetic material such as "Delryn".

The core element has an end wall 6 with a slightly protruding radial flange 7. Below said end wall openings 8 are provided. The core element is surrounded by a spring 9, the lower end of which is in engagement with the flange 2 and the upper end of which is in engagement with a support ring 10 carrying a valve ring 11.

In FIG. 1, the ring valve 10, 11 is shown in the closed position. In FIG. 2 the valve is shown in the open position which opening is performed by a device not shown.

The housing of this unit is formed by a lower metal cup-shaped part 12 and an upper metal cup-shaped part 13. Said two cup-shaped parts have outwardly extending flanges 14 and 15 respectively, which may be welded upon each other.

The bottom 16 of the lower cup-shaped part 12 is curved inwardly and exactly follows the shape of the lower side of flange 2. It has a downwardly bent central edge portion 17 fitting around the outer surface of the downwardly extending part 3 of the central core element 1.

Above flange 2 the wall of this cup-shaped part can be pressed inwardly as shown at 18 to lock this cup-shaped part in place with respect to the central core element 1.

This lower cup-shaped part has large flow openings 19.

The upper cup-shaped part 13 at the level of the end wall 6 of the central core element has been provided with an inwardly turned flange 20. As appears from the drawings, the sealing ring 11 of the ring valve 10, 11 which sealing ring can be made from resilient material such as rubber, engages the flange 7 with its inner edge 21 and flange 20 with its outer edge 22.

The cylindrical outer wall of the upper cup-shaped part 13 has been surrounded by bushing 23 made by injection molding from thermoplastic material. Said bushing has a slide fit with respect to the outer wall of the cup-shaped part 13 so that it can be shifted over said part.

Said bushing 23 has been provided with outer screw threads 24.

Bushings with different screw threads and/or diameter can be used.

The container 25 has a neck portion 26 provided with inner screw threads 27 and an inwardly extending flange 28.

The valve unit can be mounted in the neck portion of the container in a simple way by first providing a sealing ring 29 upon flange 28, thereafter placing the unit with the flanges 14, 15 upon said sealing ring 29 and then screwing down the bushing 23 until its lower end 30 presses the flanges 14, 15 against sealing ring 29 and accordingly against flange 28.

Bushing 23 has in a known manner a flange 31 for the engagement of a tool by means of which bushing 23 can be screwed down or removed.

Figure 3:
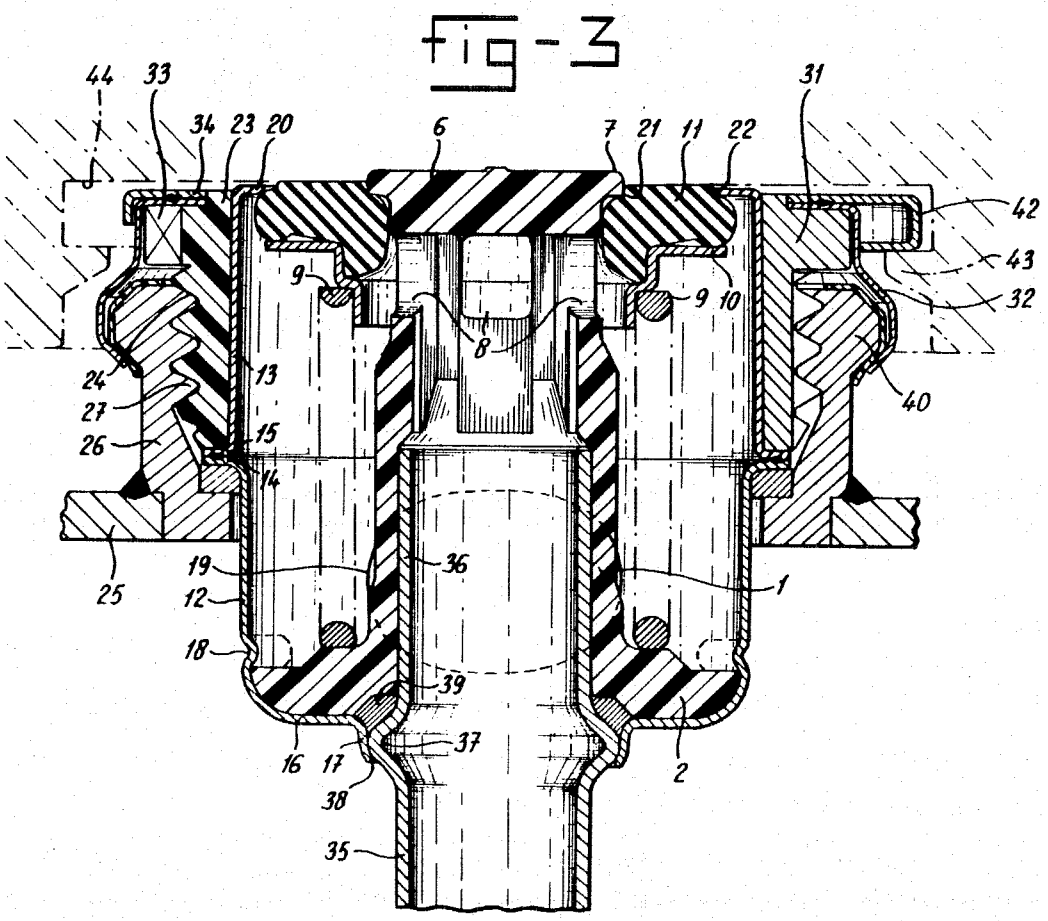
FIGS. 3 and 4 are cross sectional view of a second embodiment of the valve unit of the invention shown in the closed and open positions, respectively.
Figure 4:
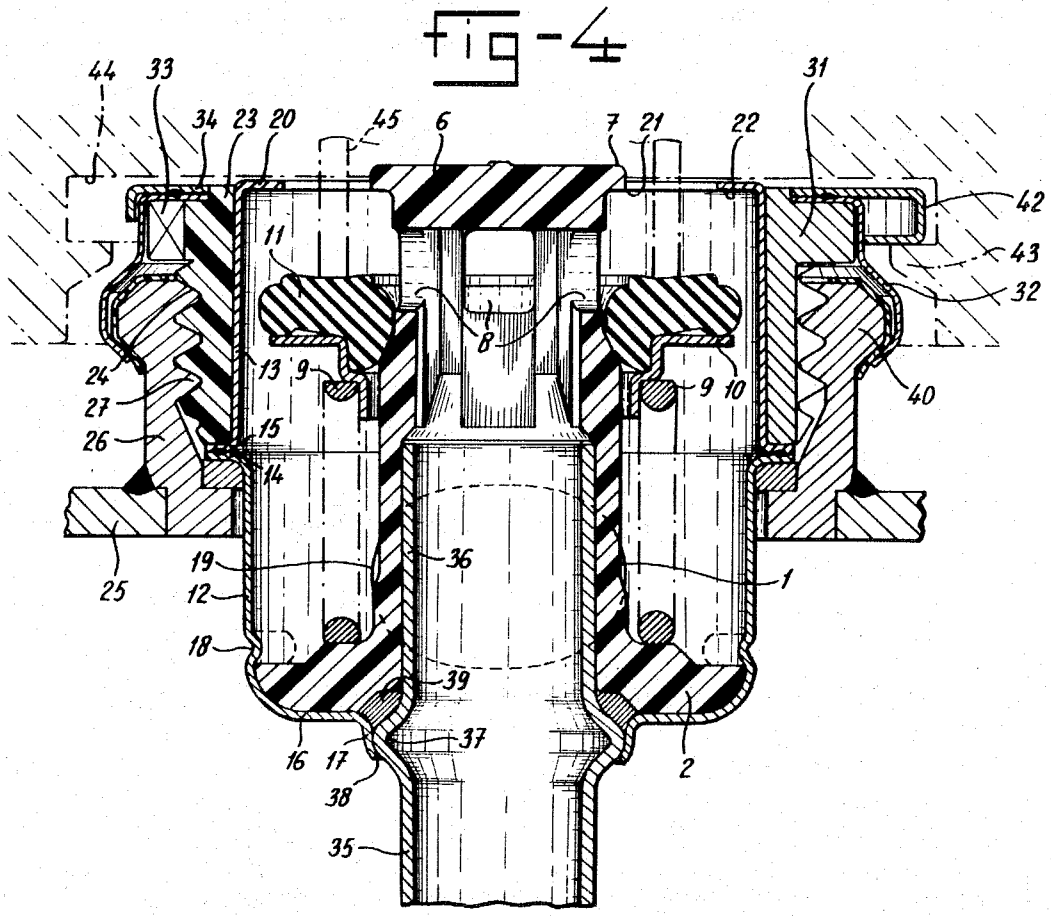

In FIGS. 3–4 a second embodiment is shown and those parts which are in principle the same as in FIG. 1 have the same reference numerals.

The embodiment of FIGS. 3–4 differs from the embodiment of FIGS. 1–2 in the manner of connecting the tube 35 with the core element 1. The tube has an upper portion 36 which can be shifted with a slide fit into the central bore of the core element 1. The tube has an outwardly bulged portion 37 and the downwardly directed portion 17 of the bottom 16 of the cup-shaped element 12 is bent inwardly as shown at 38 to lock the tube with respect to the core element 1. At 39 a resilient sealing element is shown which apart from sealing also has a shock absorbing function.

As in the case of FIGS. 1–2, in FIG. 3 the ring valve 10, 11 is shown in the closed position. In FIG. 4, the valve is shown in the open position, which opening is performed by a device not shown.

Figure 5:
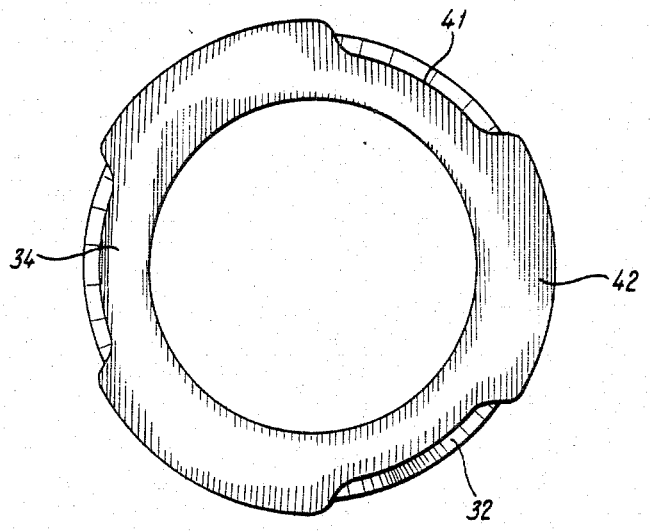
FIG. 5 is a top view of the flange forming and tamperproof making plate to be used in the embodiments of FIGS. 1–2 or 3–4.

Both the embodiments of FIGS. 1–2 and 3–4 have a bushing 23 with flange 31 provided with recesses 33 for the engagement with a tool by means of which said ring can be screwed down into the neck portion 26 as described before. On top of said bushing 23 is placed an annular plate 34 which is shown more in detail in FIGS. 5 and 6. To said plate is added a skirt 32 which as shown in FIGS. 1 through 4 is folded around an upper ridge or flange 40 of the neck portion 26. The plate 34 has recessed portions 41 and radially protruding flange portions 42 below which can grip a part 43 of a bayonet type catch of the dispensing system schematically, indicated with 44 and connected in a well known but not shown manner to a tube 45 which as shown on the left hand side of FIGS. 2 and 4, respectively, presses the valve 11 away from its seat.

Figure 6:
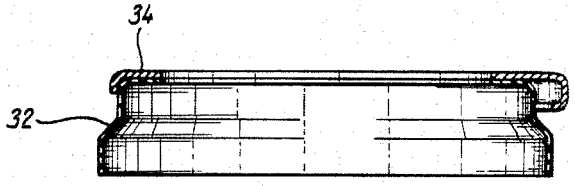
FIG. 6 is a cross section through the plate of FIG. 5 prior to its mounting.

FIG. 6 shows the skirt 32 in the undeformed shape. Due to the fact that the skirt 31 and plate 34 form a unit removal of said unit shows that misuse might have taken place and excludes the use of the connection of the bayonet type catch 44 and accordingly excludes opening of the valve. Furthermore rotation of the valve unit and accordingly unscrewing is impossible as long as the bayonet catch is not released and the tamper proof plate and skirt are not removed.

I claim:

1. A valve unit for a liquid container, said unit comprising:

a tubular core element, of thermoplastic material, having an upper end closure wall with a slightly protruding flange, a plurality of radial openings below said end wall and flange, and a radial extension spaced from said upper end and flange;

a housing secured to said radial extension and having an inwardly directed flange with an inner edge;

a ring valve having an inner edge that cooperates with said end wall flange and an outer edge that cooperates with the innner edge of said inwardly directed flange;

a spring, surrounding said tubular core element, having one end supported by said radial extension and the other end in engagement with said ring valve; and a tube connected to said tubular core element, said tube and tubular core element forming a draw-off conduit;

characterized in that said housing comprises an upper, cup-shaped metal part (12) and a lower, cup-shaped metal part (13), each said part having at its open end an outwardly extending radial flange (14, 15), which flanges (14, 15) are secured to each other; wherein said lower cup-shaped part has a wall with at least one opening (19), has an inwardly curved bottom (16) fitting over the radial extension (2) of the core element (1), and has a central opening to allow passage of said draw-off conduit; wherein said upper cup-shaped part (13) has a central opening, the diameter of which is smaller than the outer diameter of the ring valve (10, 11); and wherein said valve unit further comprises a bushing (23) having a slide fit upon a cylindrical outer surface of said upper cup-shaped part (13).

2. Valve unit as claimed in claim 1 characterized in that the tube (35) has been connected to the core element (1) by a slide fit of the tube end (36) within the central bore of the core element (1), said tube (35) having an outwardly directed circumferential bulge portion (37) below the core element (1) and supported by an inwardly bent inner edge portion (38) of the bottom (16) of the lower cup-shaped part (12).

3. A valve unit as claimed in claim 1 or 2, wherein said valve unit has an upper flange edge configuration for connection with a dispensing system, and wherein said valve unit is attachable to a container having a neck portion (26) with a shoulder (40), characterized in that the bushing (23) has screw threads (24) and a flange (31) of a shape allowing the cooperation with an in-screwing or out-screwing tool, said flange being covered by a plate having a radial flange (42) with an edge configuration (41, 42) for the connection with the dispensing system (45), and said plate having a downwardly extending skirt (32) foldable inwardly around the shoulder (40) of the neck portion (26).

* * * * *